US006343747B1

(12) United States Patent
Lin

(10) Patent No.: US 6,343,747 B1
(45) Date of Patent: Feb. 5, 2002

(54) FORK AND WEDGE-TYPE RAIL CONNECTOR

(76) Inventor: Teng-Kuo Lin, 18F-2, No. 2, Lane 175, Sec. 3, Shiou-lang Road, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/372,613

(22) Filed: Aug. 12, 1999

(51) Int. Cl.[7] ..... E01B 11/00
(52) U.S. Cl. ..... 238/151
(58) Field of Search ..... 238/151, 243, 238/244, 287, 280, 83, 167, 179, 180, 181

(56) References Cited

U.S. PATENT DOCUMENTS 3,834,620 A * 9/1974 Barlett ..... 238/287
4,485,967 A * 12/1984 Edwards ..... 238/226
5,135,164 A * 8/1992 Auer et al. ..... 238/83

* cited by examiner

*Primary Examiner*—S. Joseph Morano
*Assistant Examiner*—Robert J. McCarry, Jr.
(74) *Attorney, Agent, or Firm*—Troxell Law Office PLLC

(57) ABSTRACT

A fork and wedge-type rail connector that utilizes a fork-shaped primary element and a wedge-shaped secondary element to achieve an interlocking structure which is installed to connect rails on pre-stressed concrete railway ties, the utilization of which eliminates the noise and vibration produced due to the pressure of the rolling stock wheels on the intervals between rail sections and thereby features the practical values of environmental compliance and safety.

2 Claims, 5 Drawing Sheets

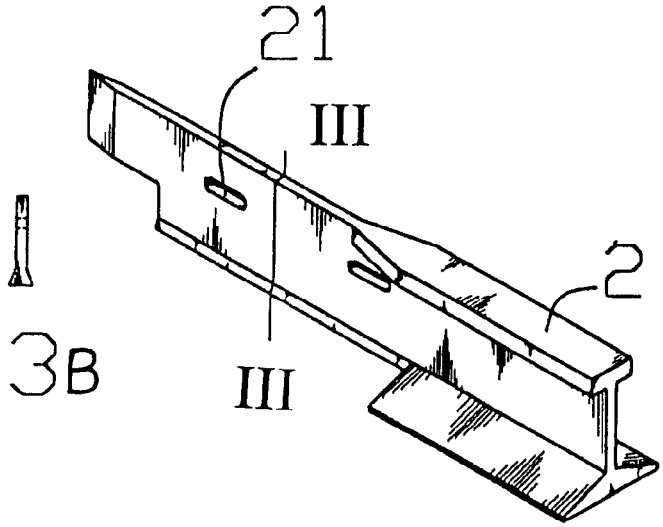
FIG 3B
FIG 3A
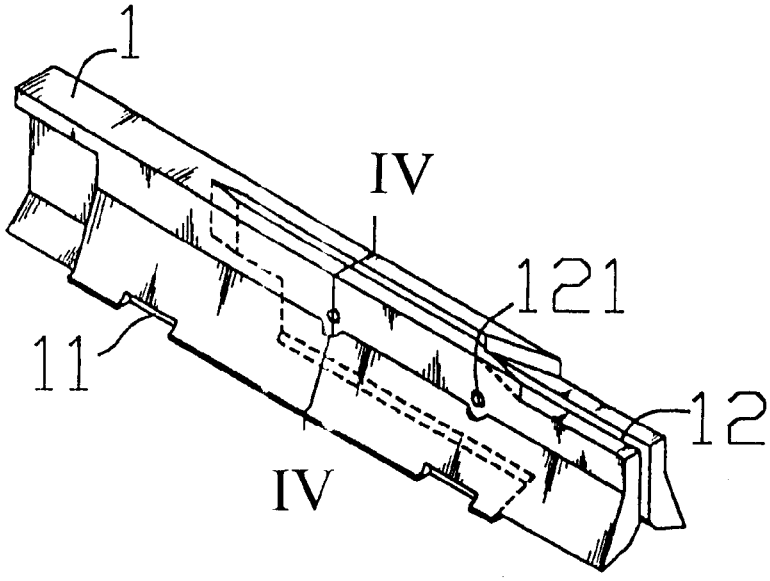
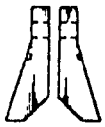
FIG 4B
FIG 4A

FORK AND WEDGE-TYPE RAIL CONNECTOR

BACKGROUND OF THE INVENTION

1) Field of the Invention

The invention herein relates to fork and wedge-type rail connector consisting of a fork-shaped primary element and a wedge-shaped secondary element, with the two elements interlocked together and secured by two bolts fastened between them. After fastening is completed, bolts or mounting hooked clasps (or rings) are utilized to mount the fork-shaped primary element conjoinment section on a pre-stressed concrete tie, with the wedge-shaped secondary element remaining unmounted to allow free railway expansion and contraction. Due to the use of such an interlocking connection structure, excessive noise, vibrations, and rail bending does not result due to moving vehicular wheel pressure.

2) Description of the Prior Art

The conventional method of connecting railway tracks involves the placement of two steel plates to clamp the two sides of the rails and then installing four to six bolts for mounting purposes. The advantages of this construction method are rapidity and low cost, but the disadvantage is that high noise levels are generated as train wheels press on the intervals between rail sections and, similar to the pulsation caused by uneven highway road surfaces, vehicle vibration results. In modern railway construction, many lengthy sections of rail are welded together to assemble a single track to minimize to the number of intervals. Although this reduces the frequency of produced noise and vibration considerably, and railway vehicle cruising is smoother, the method of construction is slower than the conventional approach and, furthermore, causes people to overlook the problem of total vibrational effects.

Metal is among the most excellent conductors of shock waves and since rails are constructed of iron, they have excellent flexibility and as a result, in addition to being capable of transmitting shock waves, are quite susceptible to induced vibrational effects. Vibrational effects are correlated with vehicle weight, speed, rail length, the frequency of vibration produced by the vehicle itself, and other cumulatively proportional factors, with rail length being the major factor. As for similarities of iron and refined steel rails) iron rails resonate easily (and this become easier as the length is increased, with the only difference being a difference in frequency). Refined steel rails are virtually impossible to resonate (regardless of length). This is because the structure of an iron rail is entirely devoid of intervals (the same applies to railway tracks), while a length of refined steel rail has countless intervals (refined steel railway is formed through innumerable links or bonds). As such, shock waves are readily transmitted in an iron rail and, furthermore, resonation is produced, but this is very difficult in refined steel, with the reason being the quantity of "intervals" (links). Since the number of "intervals" (links) of railway rails affects rolling stock transportation safety and comfort (including environmental protection), improvement is necessary.

The invention herein is an important transportation tool for railway vehicle transport in the 21st century (because it has safety, comfort, and environmental protection features) and is capable of effectively solving the shortcomings of existent railway construction methods, with the new structure of the present invention developed through extensive research based on reference materials collected during several decades of study.

SUMMARY OF THE INVENTION

Therefore, the primary objective of the invention herein is to provide a fork and wedge-type rail connector that utilizes a fork-shaped primary element and a wedge-shaped secondary element that are interlocked together to connect rails and then installed on pre-stressed concrete ties. In the structure, one of the ends of a number of clamping pieces is fitted into insets to clamp down the primary element and the other end is anchored by means of a bolt such that the clamping pieces, mounting plates, and pre-stressed concrete tie are bolted together, the utilization of which eliminates the noise and vibration produced due to the pressure of the rolling stock wheels on intervals between rail sections and thereby features the practical values of environmental compliance and safety.

To enable the examination committee to further understand the structure, innovations, and function of the invention herein, the brief description of the drawings below are followed by the detailed description of the preferred embodiments.

BRIEF DESCRIPTION OF THE DRAWINGS

FIG. 3A is an isometric drawing of the wedge-shaped structure of the invention herein.

FIG. 3B is a cross-sectional view taken along line III—III in FIG. 3A.

FIG. 4A is an isometric drawing of the fork-shaped structure of the invention herein.

FIG. 4B is a cross-sectional view taken along line IV—IV in FIG. 4A.

DETAILED DESCRIPTION OF THE PREFERRED EMBODIMENTS

Figure 1:
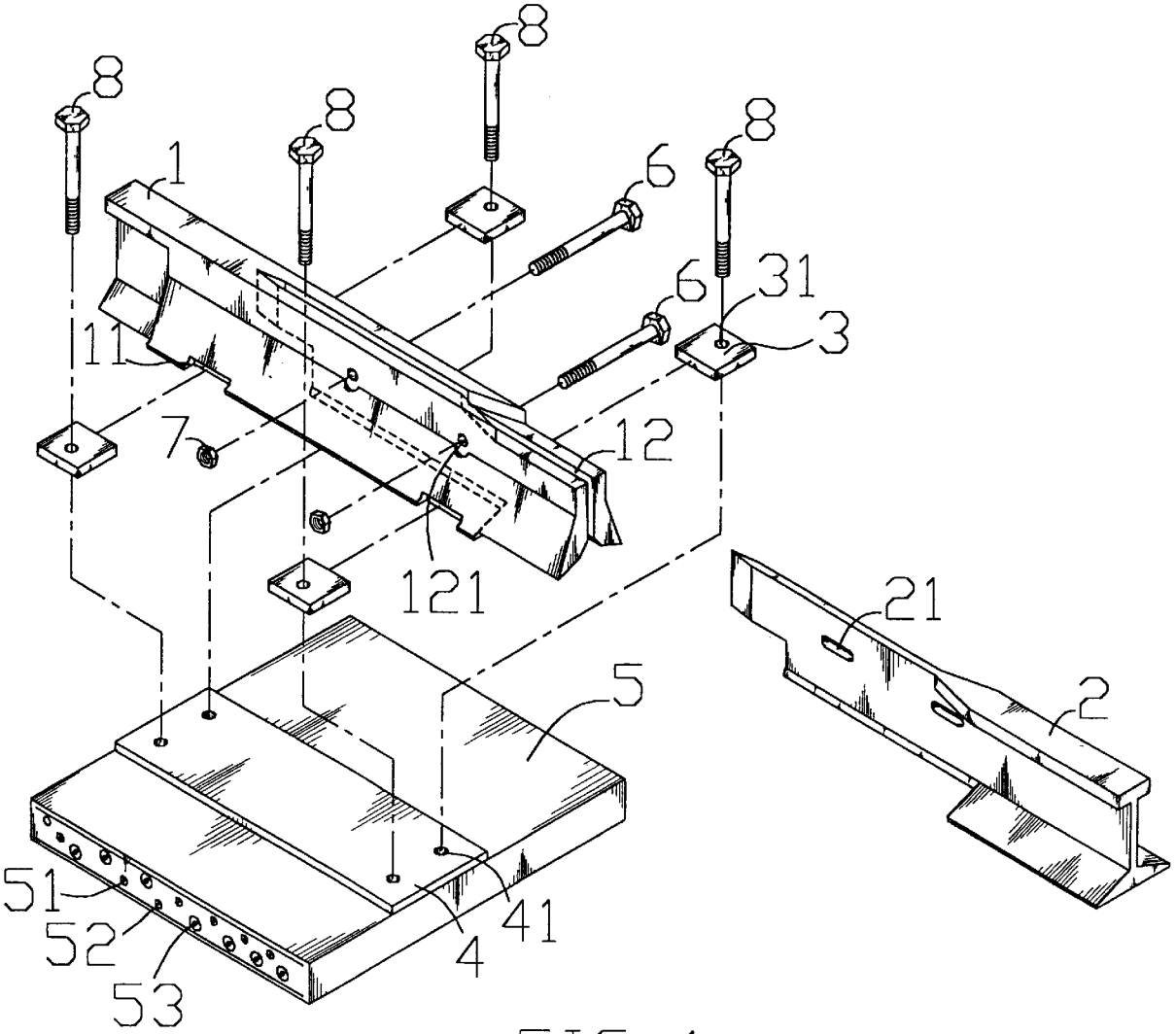
FIG. 1 is an exploded drawing of the invention herein.
Figure 2:
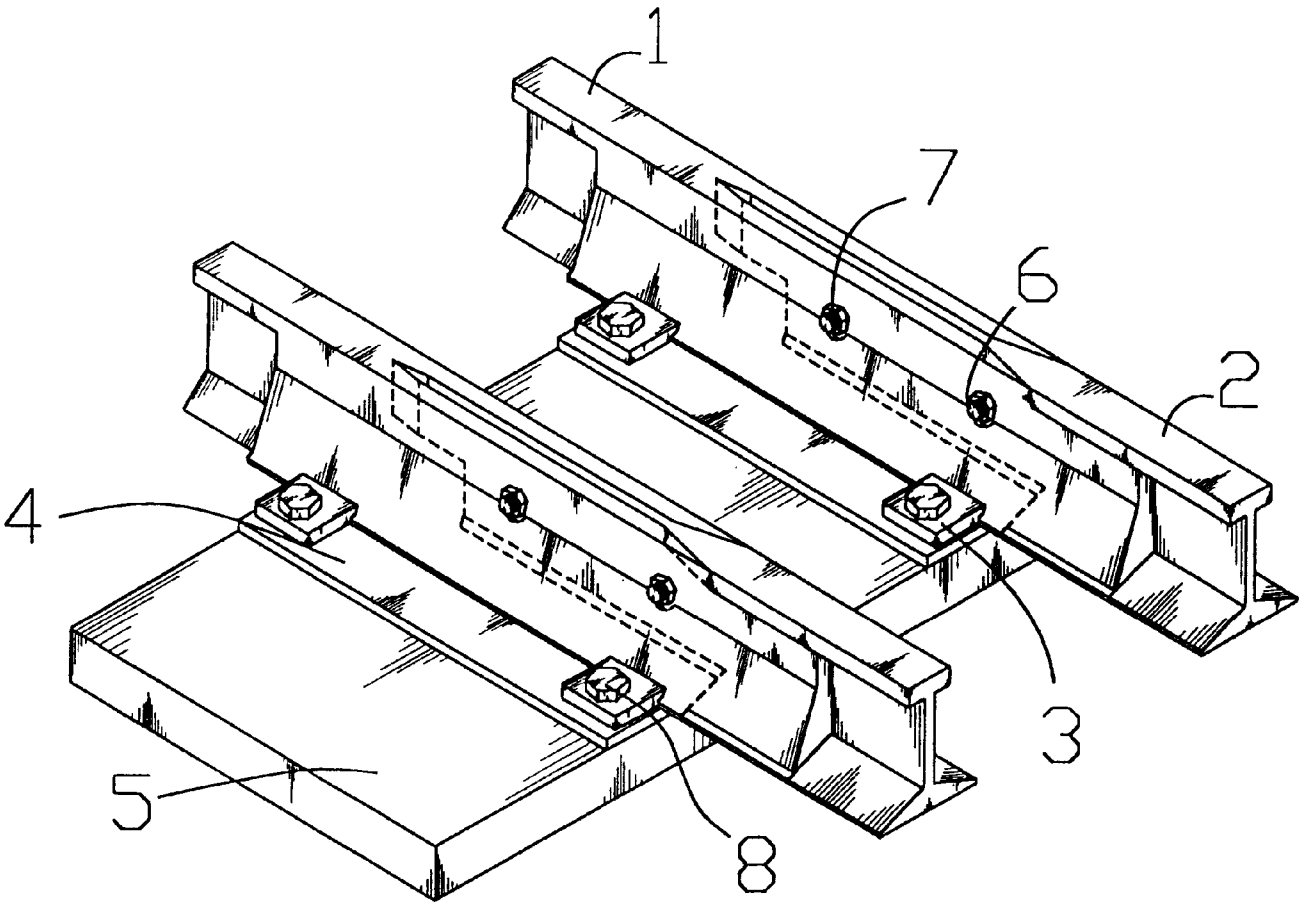
FIG. 2 is an isometric drawing of the invention herein.
Figure 5:
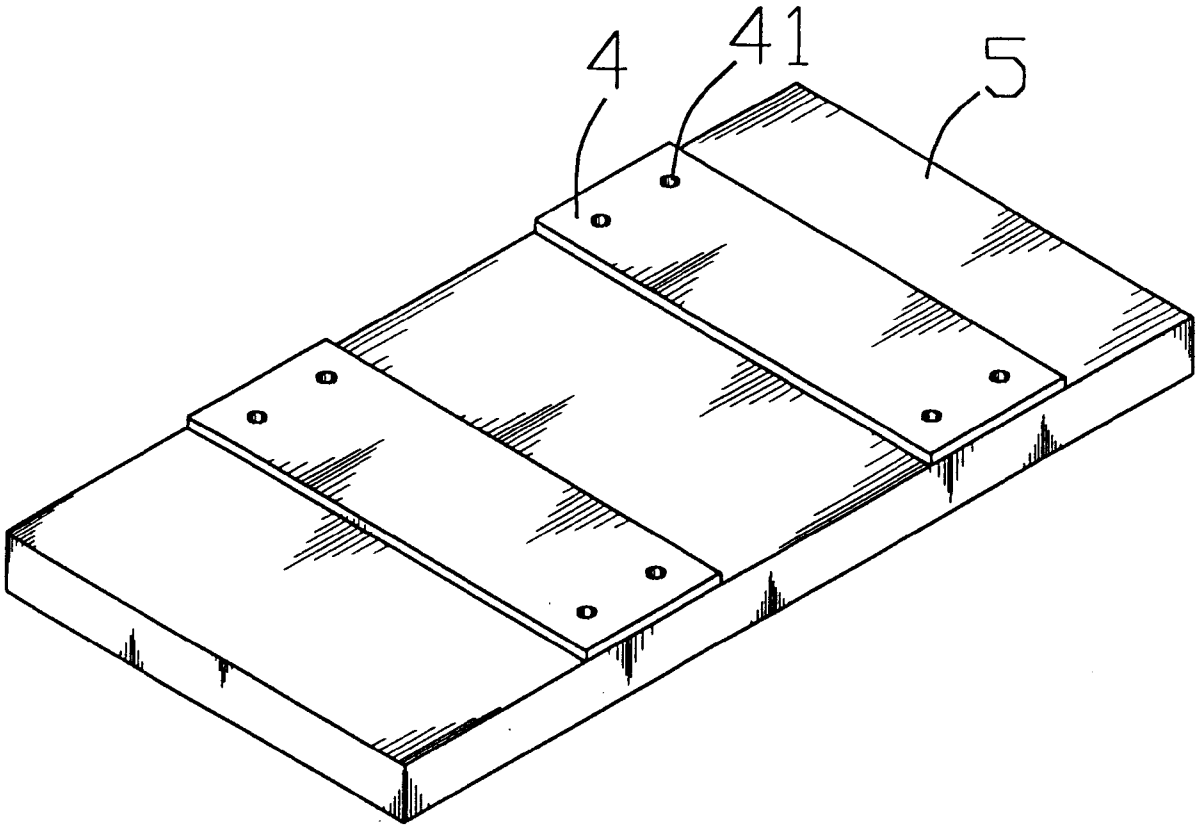
FIG. 5 is an isometric drawing of the pre-stressed concrete tie of the invention herein.
Figure 6:
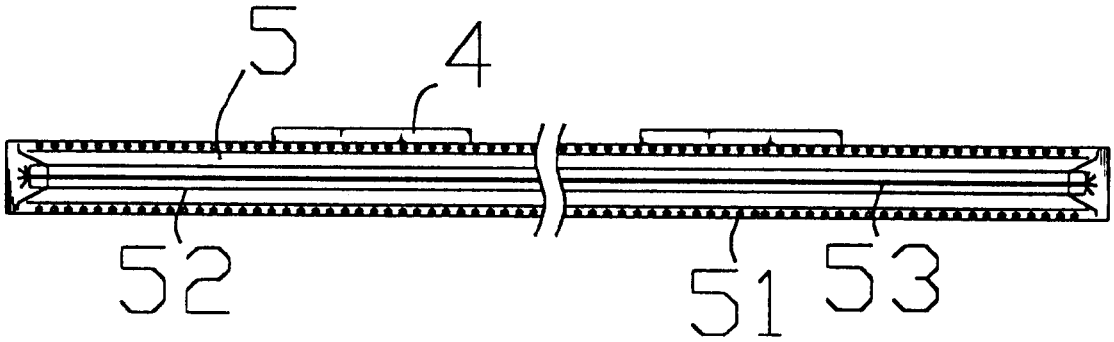
FIG. 6 is a cross-sectional drawing of the pre-stressed concrete tie of the invention herein.

Referring to the FIG. 1 and FIG. 2 and, furthermore, FIG. 3, FIG. 4, FIG. 5, and FIG. 6, the invention herein is comprised of a fork-shaped primary element 1, a wedge-shaped secondary element 2, a number of clamping pieces 3, a mounting plate 4, and a pre-stressed concrete tie 5, wherein the primary element 1 has a number of insets 11 formed in areas in the bottom sections of the two ends and a conjoinment section 12 appropriately placed along the top section; a long narrow slot extends within the conjoinment section 12 and there are beveled surfaces formed at the two sides of the tail section that accommodate the insertion of the wedge-shaped secondary element bolts 6 and fastening nuts 7 or other similar means of securing are installed through the number of holes 121 and 21 through the two sides of the conjoinment section 12 and the secondary element 2, respectively, to tightly fasten the conjoinment section 12 over the secondary element 2 to prevent the primary element 1 from bifurcating and bending, and thereby averting the separation of the primary element 1 from the secondary element 2. Ends of the clamping pieces 3 are fitted into the insets 11 to clamp down the primary element 1 and the other end serves as an anchoring section 31, with the anchoring section 31 having a bolt hole for the placement of a bolt 8 that is positioned through the anchoring sections 31 of the clamping pieces 3 as well as the mounting sections 41 of the mounting plate 4 on the pre-stressed concrete tie 5. The pre-stressed concrete tie 5 is utilized to support the rail connector constructed from the primary element 1 and the secondary element 2, with the pre-stressed concrete tie 5 having embedded pre-stressed steel rods 51, pre-stressed sleeving 52, and pre-stressed steel rope 53, wherein the pre-stressed sleeving 52 in the pre-stressed concrete tie 5 protects the pre-stressed steel rope 53, and the pre-stressed steel rope 53 increases the material strength of the pre-stressed concrete tie 5 to a level approaching that of steel.

In this structure, when rolling stock is proceeding on the rails, an extreme level of noise is not generated regardless of the speed, and the utilization of such fork-shaped secondary elements and wedge-shaped primary elements as interlocked connectors between sections of rail is a means of conjoinment which precludes concern about the expansion and contraction of the rails due to changes in temperature because the invention herein is capable of withstanding increments of expansion and contraction three to four times greater than that of conventional conjoinment approaches. For example, if a conventional railway has a maximum allowable conjoinment interval of 1 cm, then the present invention is capable of an expansion-contraction interval of up to 3 cm to 4 cm, and without the need to be concerned about vibrational effects due to railway lengthening in that high noise levels are not generated. Therefore, the welding together of numerous sections of steel tracks to build railway is unnecessary because the present invention has the greater practical value of being environmentally compliant (does not generate excessive noise), safe (not susceptible to vibrational effects and rail bending), and economical (sections of railway track can be assembled on a factory production line and no on-site welding is required).

In summation of the foregoing section, the fork and wedge-type rail connector of the invention herein has more practical value than the conventional methods, while being environmentally compliant, safe, and economical, therefore, the structure of the present invention is original and progressive.

However, the detailed description and drawings in the said disclosure only relates to a single embodiment which shall not be construed as limitation upon the actual scope of the invention herein, with various modifications to the structure and functions contained in said detailed description and the claims remaining within the spirit and scope of the invention herein.

What is claimed is:

1. A rail connection comprising:

a) a primary rail having a height and a bifurcated conjointment section with an elongated slot therein bounded on opposite sides by portions of the primary rail, the elongated slot extending through the entire height of the primary rail;

b) a secondary rail having a wedge portion extending into the slot of the primary rail between the portions of the primary rail bounding the slot, the wedge portion having a plurality of holes therethrough;

c) a plurality of fasteners extending through the holes through the wedge portion and the portions of the primary rail bounding the opposite sides of the slot;

d) at least one inset formed in the conjointment portion of the primary rail; and, e) at least one clamping piece engaged with the at least one inset.

2. The rail connection of claim 1 further comprising an end of the elongated slot being formed by two beveled surfaces.

* * * * *